US009187860B2

(12) United States Patent
Masters

(10) Patent No.: US 9,187,860 B2
(45) Date of Patent: Nov. 17, 2015

(54) LINT FILTER APPARATUS

(71) Applicant: Mark Edward Masters, Little River, SC (US)

(72) Inventor: Mark Edward Masters, Little River, SC (US)

( * ) Notice: Subject to any disclaimer, the term of this patent is extended or adjusted under 35 U.S.C. 154(b) by 0 days.

(21) Appl. No.: 14/153,840

(22) Filed: Jan. 13, 2014

(65) Prior Publication Data

US 2015/0197883 A1 Jul. 16, 2015

(51) Int. Cl.
*D06F 58/22* (2006.01)

(52) U.S. Cl.
CPC ..... *D06F 58/22* (2013.01)

(58) Field of Classification Search
CPC ..... D06F 25/00; D06F 39/10; D06F 58/22
USPC ..... 55/385.1; 34/82, 86, 218; 68/20
See application file for complete search history.

(56) References Cited

U.S. PATENT DOCUMENTS 2,742,708 A * 4/1956 McCormick ..... D06F 58/02 34/60
3,487,624 A * 1/1970 Tignanelli ..... B01D 46/10 34/82
3,789,514 A * 2/1974 Faust et al. ..... 34/82
3,999,304 A * 12/1976 Doty ..... A45D 20/52 165/901
4,227,315 A * 10/1980 Hight ..... D06F 58/22 34/604
4,435,909 A * 3/1984 Williamson, Jr. ..... 34/82
4,653,200 A * 3/1987 Werner ..... 34/82
4,720,925 A * 1/1988 Czech et al. ..... 34/82
5,236,478 A * 8/1993 Lewis ..... B01D 46/0006 34/82
6,997,966 B2 * 2/2006 Iantorno ..... B01D 46/10 34/604
7,213,349 B1 * 5/2007 Brunner ..... 34/86
2008/0047159 A1 2/2008 Mackay
2009/0158611 A1 * 6/2009 Ziemann ..... 34/218
2010/0223960 A1 * 9/2010 Kim et al. ..... 68/20
2013/0125410 A1 * 5/2013 Gregory et al. ..... 34/82

* cited by examiner

*Primary Examiner* — Duane Smith
*Assistant Examiner* — Minh-Chau Pham

(57) ABSTRACT

A lint filter apparatus is provided. The lint filter apparatus includes a chute with an intake passage and an output passage. The intake passage may be connected with an input duct of a dryer and the output passage may be connected with an exhaust duct. A filter system may be connected to the chute. The filter system may include a filter receiver that extends through an internal portion of the chute. A filter may be removably insertable into the filter receiver, thereby covering the internal portion of the chute.

13 Claims, 3 Drawing Sheets

LINT FILTER APPARATUS

BACKGROUND OF THE INVENTION

The present invention relates to a lint filter apparatus and, more particularly, to a lint filter apparatus to further prevent lint build up within a dryer vent.

A clothes dryer, tumble dryer, or drying machine is a household appliance that is used to remove moisture from a load of clothing and other textile, generally shortly after they are cleaned in a washing machine. Tumbler dryers continuously draw in the cool, dry, ambient air around them and heat it before passing it through the tumbler. The resulting hot, humid air is usually vented outside to make room for more dry air to continue the drying process.

Moisture and lint are byproducts of the tumble drying process, and are pulled from the drum by a fan motor and then pushed through the remaining exhaust conduit to the exterior termination fitting. Typical exhaust conduit comprises flex transition hose found immediately behind the dryer, the 4-inch (100 mm) rigid galvanized pipe and elbow fittings found within the wall framing, and the vent duct hood found outside the house. As the dryer duct pipe becomes partially obstructed and filled with lint, drying time increases and causes the dryer to overheat and waste energy. In extreme cases, a blocked vent may result in a fire.

As can be seen, there is a need for a device that further prevents lint build up within the dryer vent.

SUMMARY OF THE INVENTION

In one aspect of the present invention, a lint filter apparatus comprises: a chute comprising an intake passage and an output passage, wherein the intake passage is configured to connect with an input duct of a dryer and the output passage is configured to connect with an exhaust duct; a filter receiver extending through an internal portion of the chute; and a filter removably insertable into the filter receiver, wherein the filter covers the internal portion of the chute, wherein air is directed upward through the intake passage, downward through the filter, and then upward through the output passage.

In another aspect of the present invention, a lint filter apparatus comprises: a chute comprising a U-shaped first chamber comprising an intake passage and a U-shaped second chamber comprising an output passage, a filter receiver extending through an internal portion of the chute in between the first chamber and the second chamber; and a filter removably insertable into the filter receiver, wherein the filter covers the internal portion of the chute.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a lint filter apparatus. The lint filter apparatus includes a chute with an intake passage and an output passage. The intake passage may be connected with an input duct of a dryer and the output passage may be connected with an exhaust duct. A filter system may be connected to the chute. The filter system may include a filter receiver that extends through an internal portion of the chute. A filter may be removably insertable into the filter receiver, thereby covering the internal portion of the chute.

The present invention may greatly reduce the amount of lint buildup in the clothes dryer ductwork in a home. The present invention adds to an existing clothes dryer ductwork, utilizing a second lint filter, which may be removed and cleaned when needed. The lint screen within the dryer may not perform adequately, and fails to remove all of the lint that may go through the ductwork. Therefore, additional lint filters may be utilized.

Figure 1:
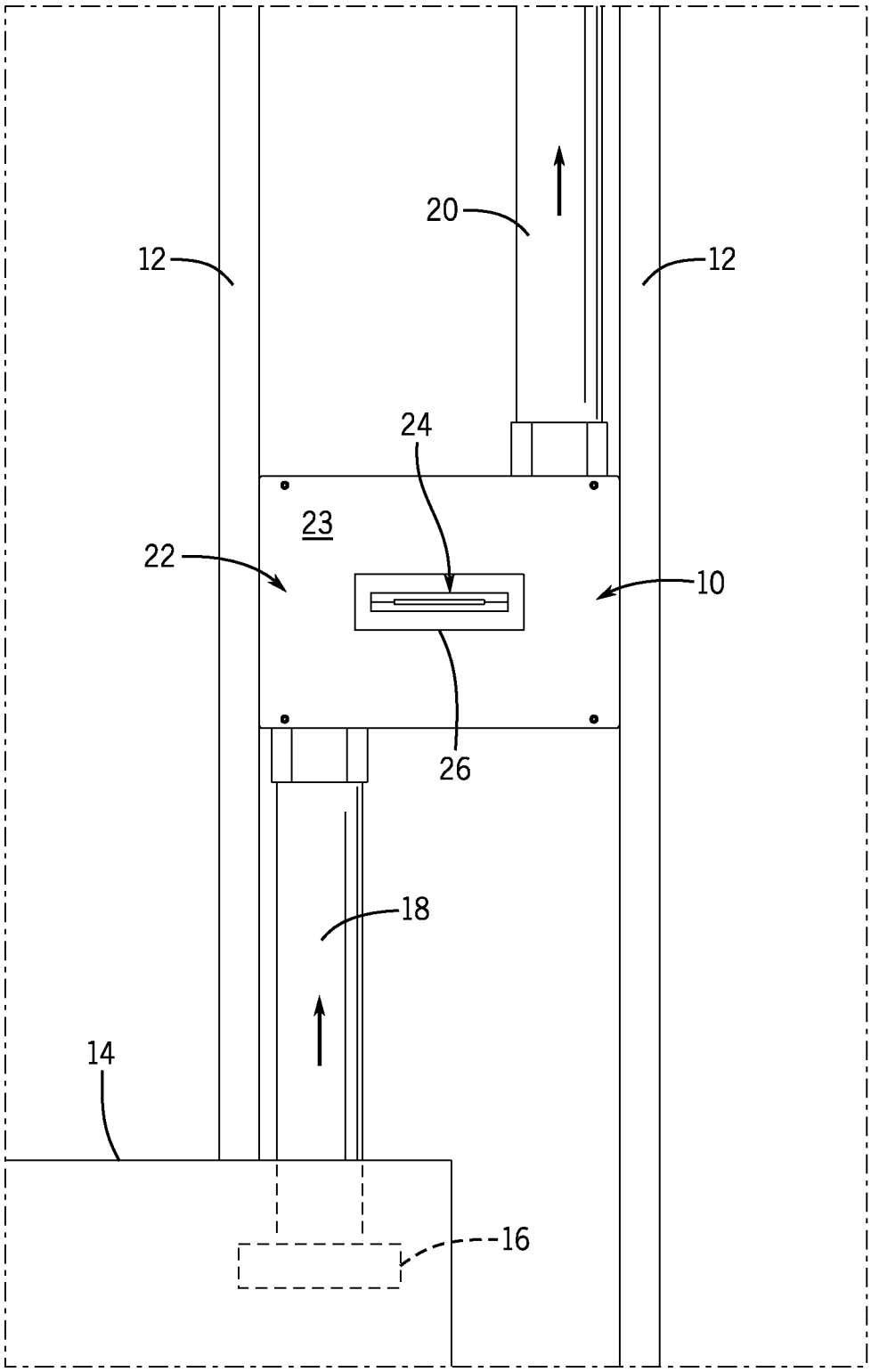
FIG. 1 is a front elevation view of the present invention in use.
Figure 2:
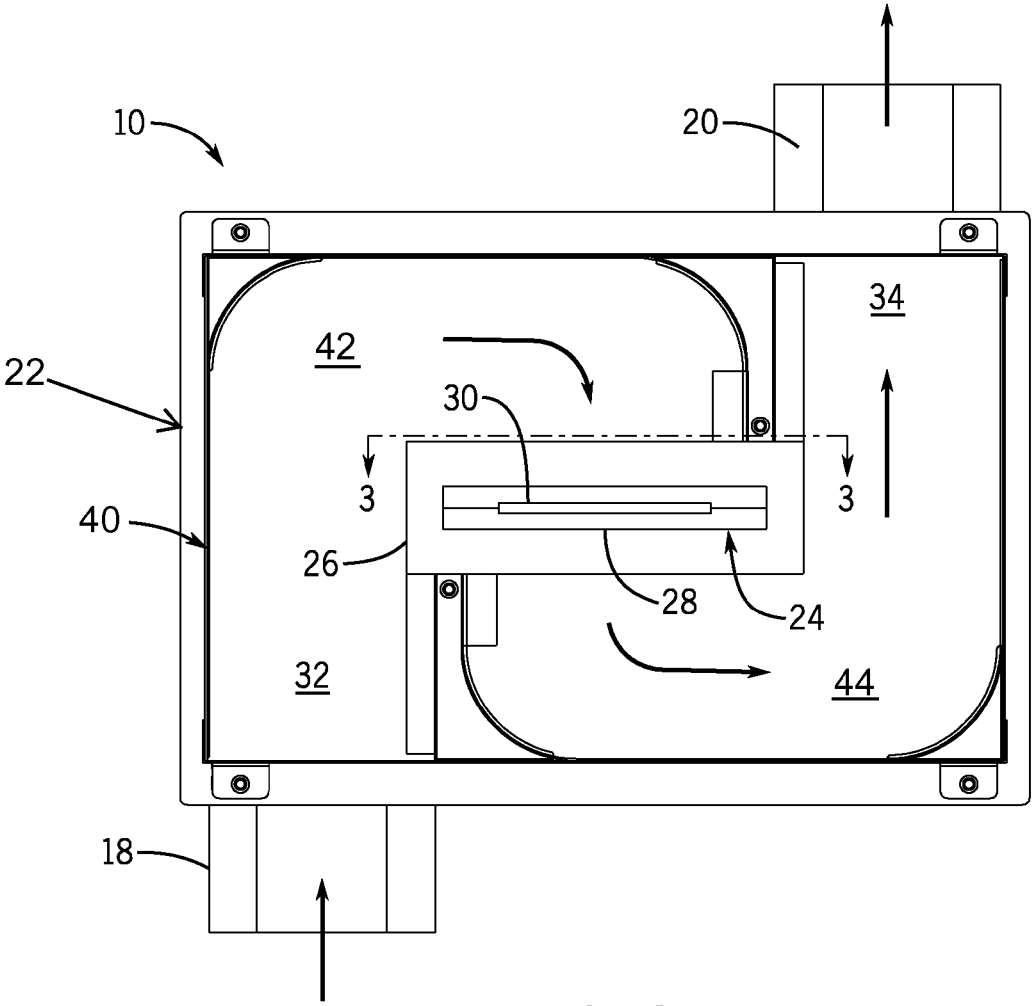
FIG. 2 is a front elevation view of the present invention with the cover removed.
Figure 3:
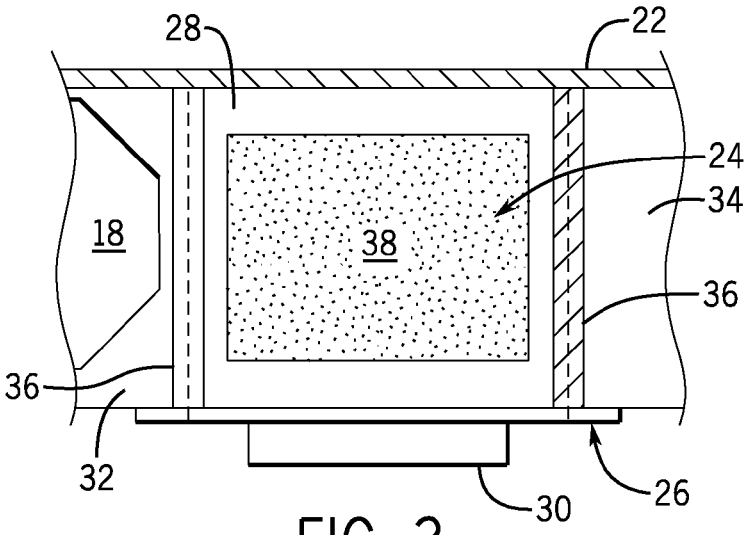
FIG. 3 is a cross-sectional view take on line 3-3 of FIG. 2.
Figure 4:
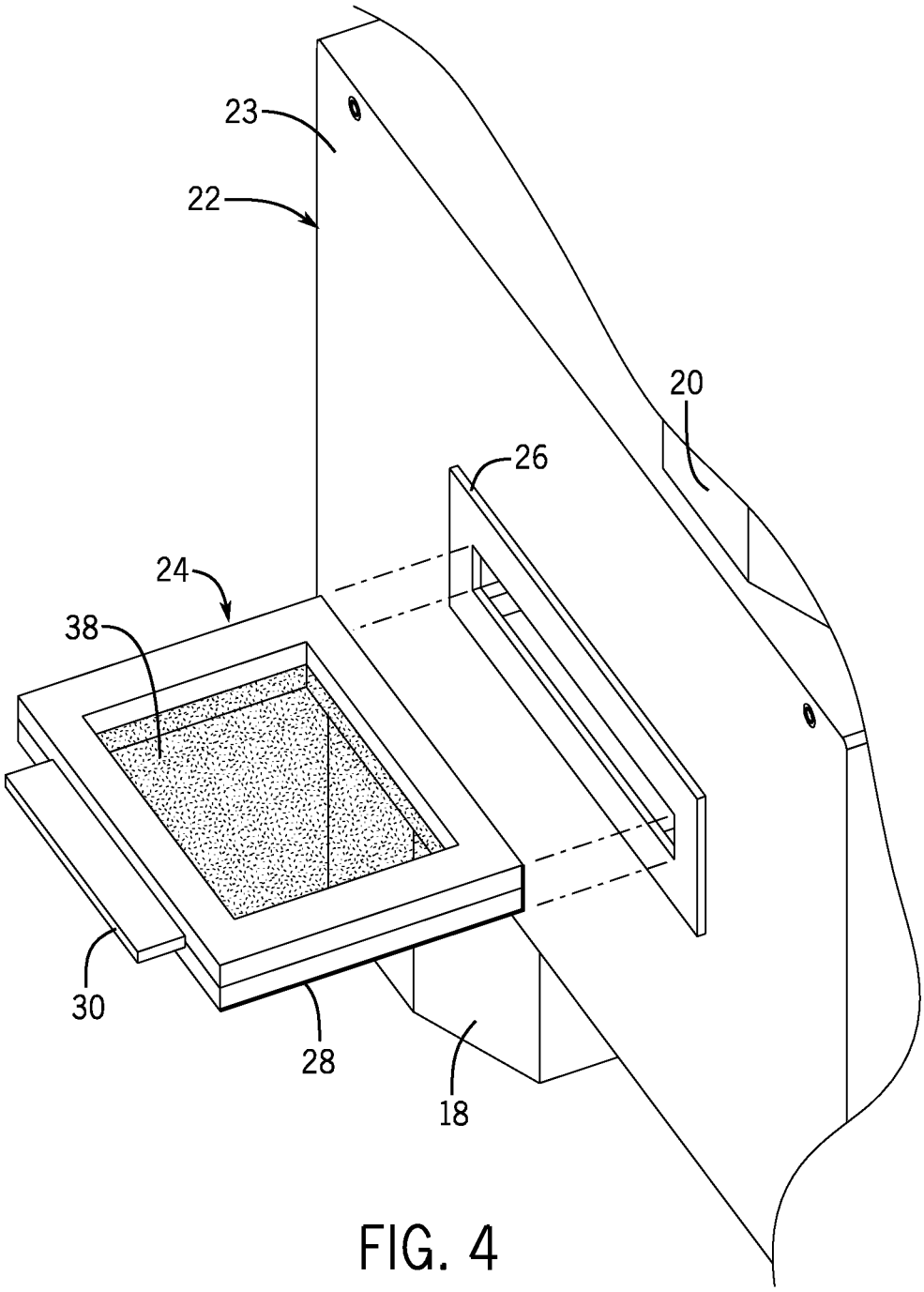
FIG. 4 is an exploded perspective view of the present invention.

Referring to FIGS. 1 through 4, the present invention may include a lint filter apparatus 10. The lint filter apparatus 10 may include a chute 40 with an intake passage 32 and an output passage 34. The intake passage 32 may be connected with an input duct 18 of a dryer 14 and the output passage 34 may be connected with an exhaust duct 20. A filter system 24 may be connected to the chute 40. The filter system 24 may include a filter receiver 26 that extends through an internal portion of the chute 40. A filter 38 may be removably insertable into the filter receiver 26, thereby covering the internal portion of the chute 40.

In certain embodiments, the chute 40 of the present invention may include a first chamber 42 and a second chamber 44. The first chamber 42 and second chamber 44 may be a U-shaped. The first chamber 42 may be an upside down U-shape and may be joined with the right side up U-shaped second chamber 44. The filter receiver 26 may be in between the first chamber 42 and the second chamber 44. Therefore, when the filter 38 is within the filter receiver 26, the filter may separate the first chamber 42 and the second chamber 44.

In certain embodiments, a housing 22 may surround the chute 40. The housing 22 may include a surface 23. In such embodiments, the filter receiver 26 may be formed on the surface 23 of the housing 22. The housing 22 of the present invention may be mounted in between two wall studs 12. The housing 22 may be mounted to the wall above the dryer 14.

In certain embodiments, a filter frame 28 may surround the perimeter of the filter 38 and may secure the filter 38 within. The filter receiver 26 may include slide guides 36 formed to receive and secure the filter frame 24 within the filter receiver 26. In certain embodiments, a handle 30 may be attached to the filter frame 28 to easily manipulate the filter frame 24. The handle 30 may be positioned to protrude passed the surface 23 of the housing 22 when the filter frame 24 is within the filter receiver 26.

The lint filled air may flow through the lint filter 16 and into the input duct 18. From the input duct 18, the air may flow into the chute 40 through the intake passage 32. The air may be directed upward through the intake passage and downward through the filter 38. The filter 38 may collect additional lint from the airflow. The airflow may then be directed upward through the output passage 34 and into the exhaust duct 20. When a user would like to clean the filter 38, the user may remove the filter 38 from the filter receiver 26, clean the filter 38 and then place the filter 38 back into the filter receiver 26.

A method of making the present invention may include the following. Build the housing using galvanized steel sheets leaving the 6th side open (the face), bending sheets with a metal break and sealing seams where joined with solder or aluminum tape. Use additional galvanized sheet metal to create the two vertical ribs making up the walls between the chambers in the housing. Each rib may be about 4" shorter than the housing height. The first vertical rib may be installed about 4" from the left wall and secured to the bottom and back wall with solder so that there is a about 4½" gap at the top. The second vertical rib may be mounted about 4½" from the right wall but may be attached to the top and back wall, leaving a gap at the bottom. Apply a self adhesive weather strip to the edge of the ribs so that when the housing is installed the air may travel through the chambers properly. Use galvanized steel sheeting to create the drawer brackets, installing them on the vertical ribs so that they face each other in the middle of the chambers creating a "sleeve" effect. Weather strips may be used to help seal the lint screen receiver. The lint screen drawer may be made of a rigid plastic or acrylic so as to retain its shape to create a good seal on the bottom of the drawer brackets. The receiver's dimensions may be: about 3½" from front to back, about 5½" wide and about ¼" thick. The rigid receiver plastic may have a rectangular hole in the center so that there is a border of plastic ¾ all the way around, creating a frame for the screen which may be glued to the frame. Create a "face" for the receiver using the same rigid plastic or acrylic, making it about 4"×6". This may be glued onto the front of the drawer assembly. Thin, self adhesive, foam insulating weather strip may be attached to the back side of the drawer face creating a good seal. Use galvanized sheet metal for the sixth side (the face). Bend sheet metal in a break, creating a "lid" for the housing. Cut a rectangular hole where the drawer will slide in out. Secure the "face" to the housing with aluminum tape. The above method recited is an exemplary method of making the present invention, and any method known in the art may be used to make the present invention.

It should be understood, of course, that the foregoing relates to exemplary embodiments of the invention and that modifications may be made without departing from the spirit and scope of the invention as set forth in the following claims.

What is claimed is:

1. A lint filter apparatus comprising:

a chute comprising an intake passage and an output passage, wherein the intake passage is configured to connect with an input duct of a dryer and the output passage is configured to connect with an exhaust duct;

a filter receiver extending through an internal portion of the chute; and a filter removably insertable into the filter receiver, and disposed parallel with the intake passage and the output passage, wherein the filter covers the internal portion of the chute, wherein air is directed upward through the intake passage, downward through the filter, and then upward through the output passage.

2. The lint filter apparatus of claim 1, further comprising a housing surrounding the chute, wherein the filter receiver is formed on a surface of the housing.

3. The lint filter apparatus of claim 2, further comprising a filter frame surrounding the perimeter of the filter.

4. The lint filter apparatus of claim 3, wherein the filter receiver comprises slide guides formed to receive and secure the filter frame within the filter receiver.

5. The lint filter apparatus of claim 2, further comprising a handle attached to the filter frame, wherein the handle is positioned to protrude passed the surface of the housing when the filter frame is within the filter receiver.

6. The lint filter apparatus of claim 1, wherein the input duct of the dryer leads to a dryer lint filter within the dryer.

7. A lint filter apparatus comprising:

a chute comprising a first chamber comprising an upside down U-shape and a second chamber comprising a right side up U-shape;

a filter receiver extending through an internal portion of the chute in between the first chamber and the second chamber; and a filter removably insertable into the filter receiver, wherein the filter covers the internal portion of the chute.

8. The lint filter apparatus of claim 7, further comprising a housing surrounding the chute, wherein the filter receiver is formed on a surface of the housing.

9. The lint filter apparatus of claim 7, further comprising an input duct of a dryer connected to an intake passage of the first chamber and an exhaust duct connected to an output passage, of the first chamber, wherein the input duct leads to a dryer lint filter within the dryer.

10. The lint filter apparatus of claim 7, further comprising a filter frame surrounding the perimeter of the filter.

11. The lint filter apparatus of claim 10, wherein the filter receiver comprises slide guides formed to receive and secure the filter frame within the filter receiver.

12. The lint filter apparatus of claim 8, further comprising a handle attached to the filter frame.

13. A filter system for a dryer comprising: an input duct secured to a dryer; a chute comprising an intake passage and an output passage, wherein the intake passage is connected with the input duct; an exhaust duct secured to the output passage to the chute; a filter receiver extending through an internal portion of the chute; and a chute filter removable insertable into the filter receiver and disposed parallel with the intake passage and the output passage, wherein the chute filter covers the internal portion of the chute, wherein air is directed through a dryer lint filter of the dryer and exits the dryer into the input duct entering upward through the intake passage and passing downward through the chute filter, and then upward through the output passage and into the exhaust duct.

* * * * *